United States Patent [19]

Larson et al.

[11] 4,367,380

[45] Jan. 4, 1983

[54] KEYBOARD ASSEMBLY AND COMPONENTS THEREFOR

[75] Inventors: Willis A. Larson, Crystal Lake; Herbert C. Naylor, West Dundee, both of Ill.

[73] Assignee: Oak Industries Inc., Rancho Bernardo, Calif.

[21] Appl. No.: 181,708

[22] Filed: Aug. 27, 1980

[51] Int. Cl.[3] ..... H01H 13/70

[52] U.S. Cl. ..... 200/5 R; 200/50 C

[58] Field of Search ..... 200/5 E, 17 R, 50 C, 200/153 J, 159 R, 328, 5 R, 153 L, 153 LB

[56] References Cited

U.S. PATENT DOCUMENTS

| | | | |
|---|---|---|---|
| 3,962,556 | 6/1976 | Kravchuck | 200/153 J |
| 4,112,277 | 9/1978 | Kleeb | 200/153 J |
| 4,218,598 | 8/1980 | Iwasaki et al. | 200/153 J |
| 4,242,545 | 12/1980 | Schweitzer | 200/153 J |

*Primary Examiner*—J. R. Scott

*Attorney, Agent, or Firm*—Kinzer, Plyer, Dorn & McEachran

[57] ABSTRACT

A keyboard switch assembly includes a membrane switch matrix formed on a baseplate. There are a plurality of individual pressure applicators or keys which are mounted on the baseplate in a keyboard array. The keys are supported adjacent the membrane switch panel with each key being used to effect contact closure at a particular area of the membrane switch. Each key includes a movable plunger, a housing to support the plunger, a first coil spring biasing the plunger away from the membrane switch and a keytop affixed to the plunger. A second coil spring is seated upon the membrane switch matrix and provides the means for application of electrical contact closure pressure. Each key housing includes an enclosure which is accessible from the top of the housing. The closure is adapted to receive and retain a cam follower which controls movement of the plunger. The key housings further include a hook which can support a torsion rod. A torsion rod may be attached to an elongated keytop in an adjacent row to prevent binding of the plunger carrying the elongated keytop.

19 Claims, 8 Drawing Figures

Fig. 1.
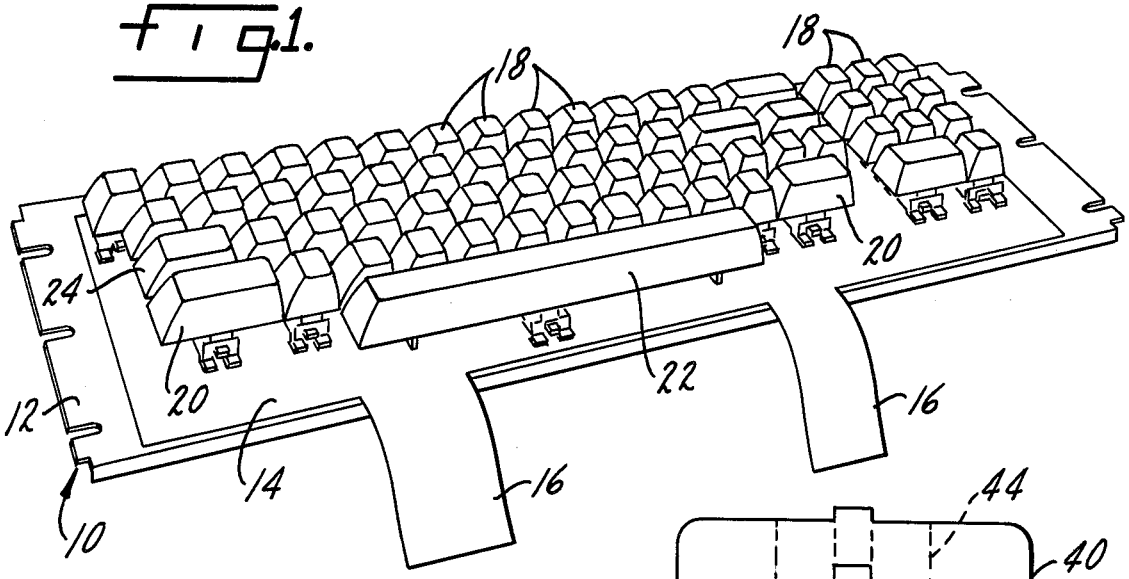
Fig. 2.
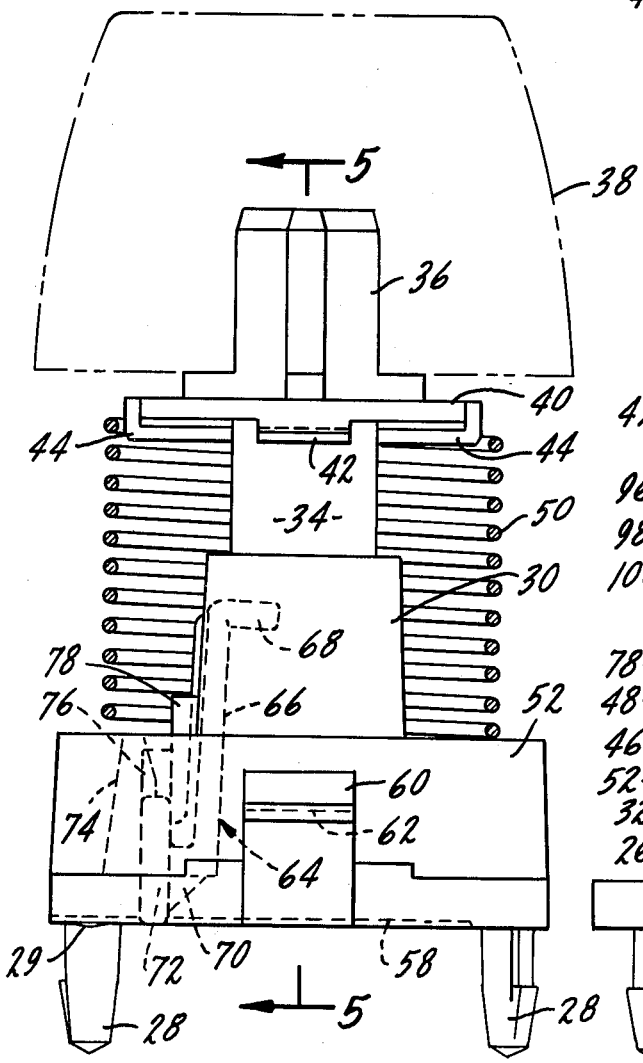
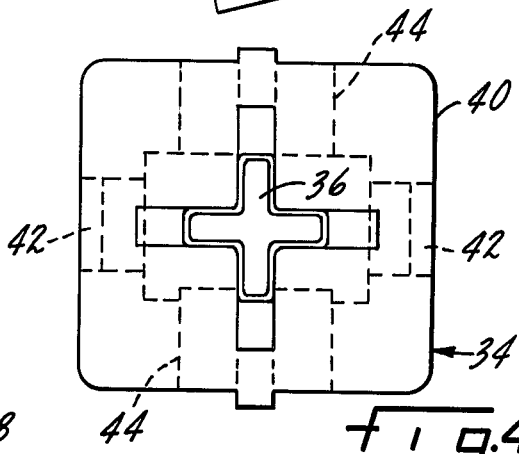
Fig. 4.
Fig. 3.
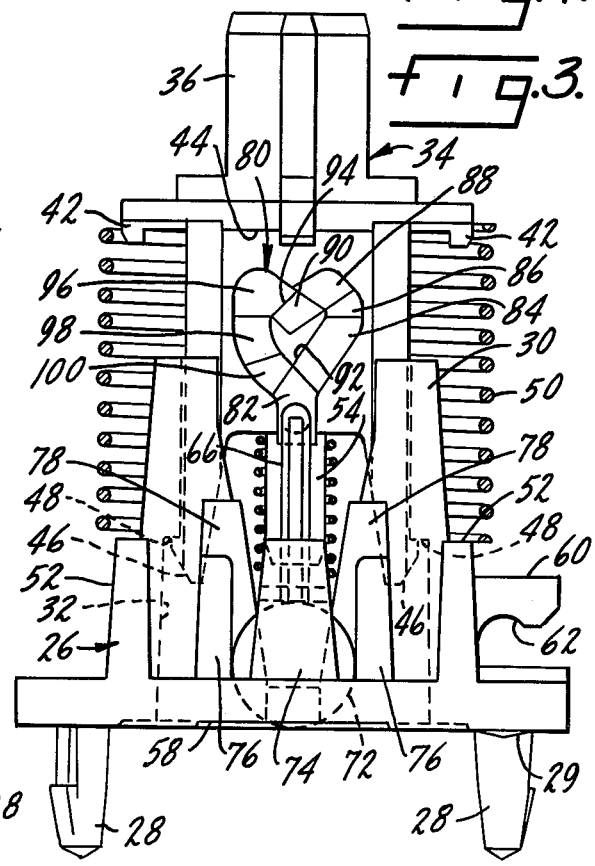

KEYBOARD ASSEMBLY AND COMPONENTS THEREFOR

SUMMARY OF THE INVENTION

The present invention relates to keyboard switch assemblies and is especially adapted for use with a membrane-type switch.

One purpose of the invention is a keyboard assembly of the type described which permits maximum flexibility in design and manufacture of various key arrays.

Another purpose is a keyboard construction of the type described in which an elongated keytop can be placed at any point in the key array.

Another purpose is a keyboard construction in which binding of keys is eliminated.

Another purpose is a keyboard construction wherein any of the keys can be adapted for alternate action type operation after the key has been mounted on a baseplate.

Another purpose is a standard, individual switch module which can be combined with other switch modules to form any keyboard array.

Other purposes will appear in the ensuing specification, drawings and claims.

BRIEF DESCRIPTION OF THE DRAWINGS

FIG. 1 is a perspective view of a typical keyboard assembly according to the present invention.

FIG. 2 is a front elevation view, with parts in section, of a switch module.

FIG. 3 is a side elevation view, with parts in section of a switch module as viewed from the left side of FIG. 2.

FIG. 4 is a top plan view of a plunger, with the keytop removed.

DESCRIPTION OF THE PREFERRED EMBODIMENT

Figure 5:
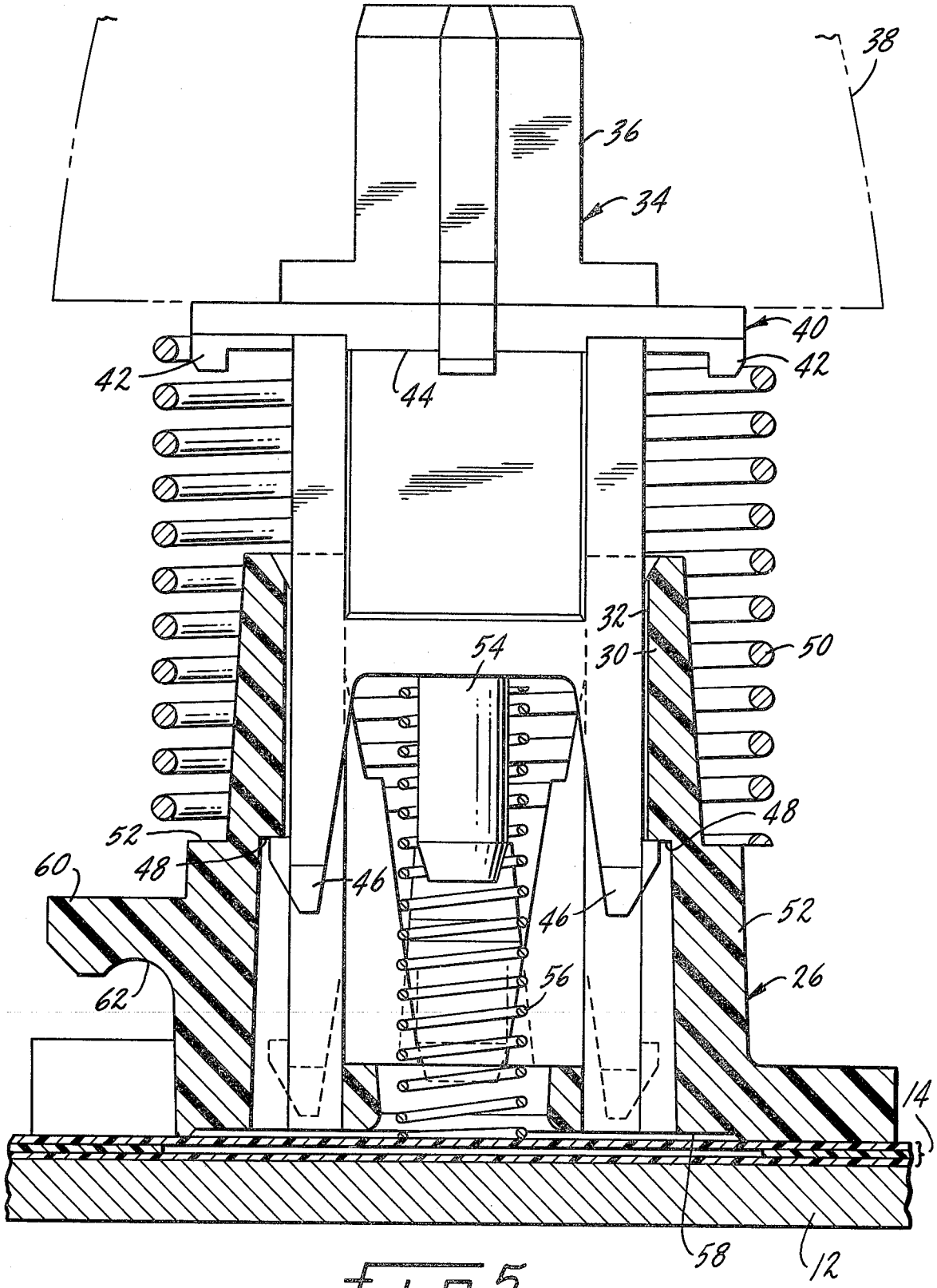
FIG. 5 is a section taken generally along line 5—5 of FIG. 2.

The present invention relates to keyboard assemblies and the components thereof. Such keyboards may customarily be used in electronic typewriters, computer terminals, and other data entry devices. The invention is particularly adapted for use with a membrane-type switch matrix.

One of the important factors in the manufacture of economical keyboard assemblies is flexibility in the location and type of keys. An economical keyboard design must be adaptable to accept an endless variety of key arrays and types. Given the diversity of applications, it can be seen that different users will require different keyboard constructions. Among the variables that need to be accommodated are: the number of rows of keys, the width of the keyboard (that is, the number of columns of keys), the width of the keytops, and the type of key action, e.g., momentary contact or alternate action. The present invention is directed to a keyboard assembly having components which readily accommodate all these factors.

Looking specifically at FIG. 1, a keyboard assembly is shown generally at 10. The assembly includes a baseplate 12 formed from a material which is substantially rigid. Aluminum on the order of 0.060 inches thick has been found to be satisfactory although other materials could be used. A membrane switch panel 14 is positioned on the baseplate 12. The membrane switch panel may be of a type well known in the art and consists generally of a membrane and a substrate, one or both of which may be flexible, and each of which has an array or pattern of electrical conductors and contacts formed thereon. A spacer normally maintains the membrane and substrate in a spaced-apart relation with the application of isolated or local pressure to the membrane causing mechanical and thus electrical contact between the conductors through the spacer openings to thereby perform a switching function. The membrane switch has one or more tails 16 for connecting the conductors to associated electronics.

The isolated pressure is applied in the present invention through the use of individual pressure applicators or keys supported upon the membrane switch panel. The overall keyboard array may include a plurality of individual pressure applicators or keys indicated at 18. In FIG. 1 the keys are shown in a standard typewriter configuration, together with an auxiliary key section at the right hand side of the keyboard. It can be seen that some of the keys have an elongated keytop. For example, in a conventional typewriter the shift keys 20 and a spacer bar 22 will have elongated keytops affixed to an otherwise standard switch module. Also, certain keys such as a shift lock 24 require an alternate action type switch. An alternate action switch is one which remains actuated when initially depressed and requires a second application of pressure to release the switch.

The individual switch modules are indicated in detail in FIGS. 2, 3 and 4. As used herein, the term "switch module" will refer to the housing, a plunger and springs described below. The term "key" refers to a switch module plus a keytop. Each switch module includes a housing 26. A pair of projections or legs 28 extend downwardly from the base of the housing. The legs snap into openings in the membrane switch 14 and baseplate 12, providing an interim retention means. The legs 28 may then be ultrasonically staked or heat staked. The pair of projections 29 are formed on opposite corners of the underside of the housing. These assist in maintaining a secure staking and compensate for any lack of flatness in the housing when it is staked.

The housing 26 has a central chamber 30 which defines a cavity or channel 32. A plunger 34 is reciprocally movable within the channel 32. The plunger has a head 36 of cruciform shape to which a keytop may be attached. A keytop 38 is shown in phantom in FIG. 2.

The plunger 34 has a shoulder 40 which includes a pair of extensions 42 and projections 44. The plunger 34 further includes a pair of downwardly extending hook portions 46. The hooks 46 cooperate with stops 48 formed on the surface of channel 32 to both hold the plunger within housing 26 and restrict upward movement of the plunger as illustrated in FIG. 5. Conventionally, the hooks 46 will be inwardly depressed when the plunger is inserted within the channel 32 with the hooks snapping back to the position of FIG. 5 once insertion is complete. In this connection, both the plunger 34 and the housing 26 will conveniently be formed of a suitable plastic. The shoulder 40 cooperates with the top land of the chamber 30 to limit the downward movement of the plunger 34.

Figures 6, 7:
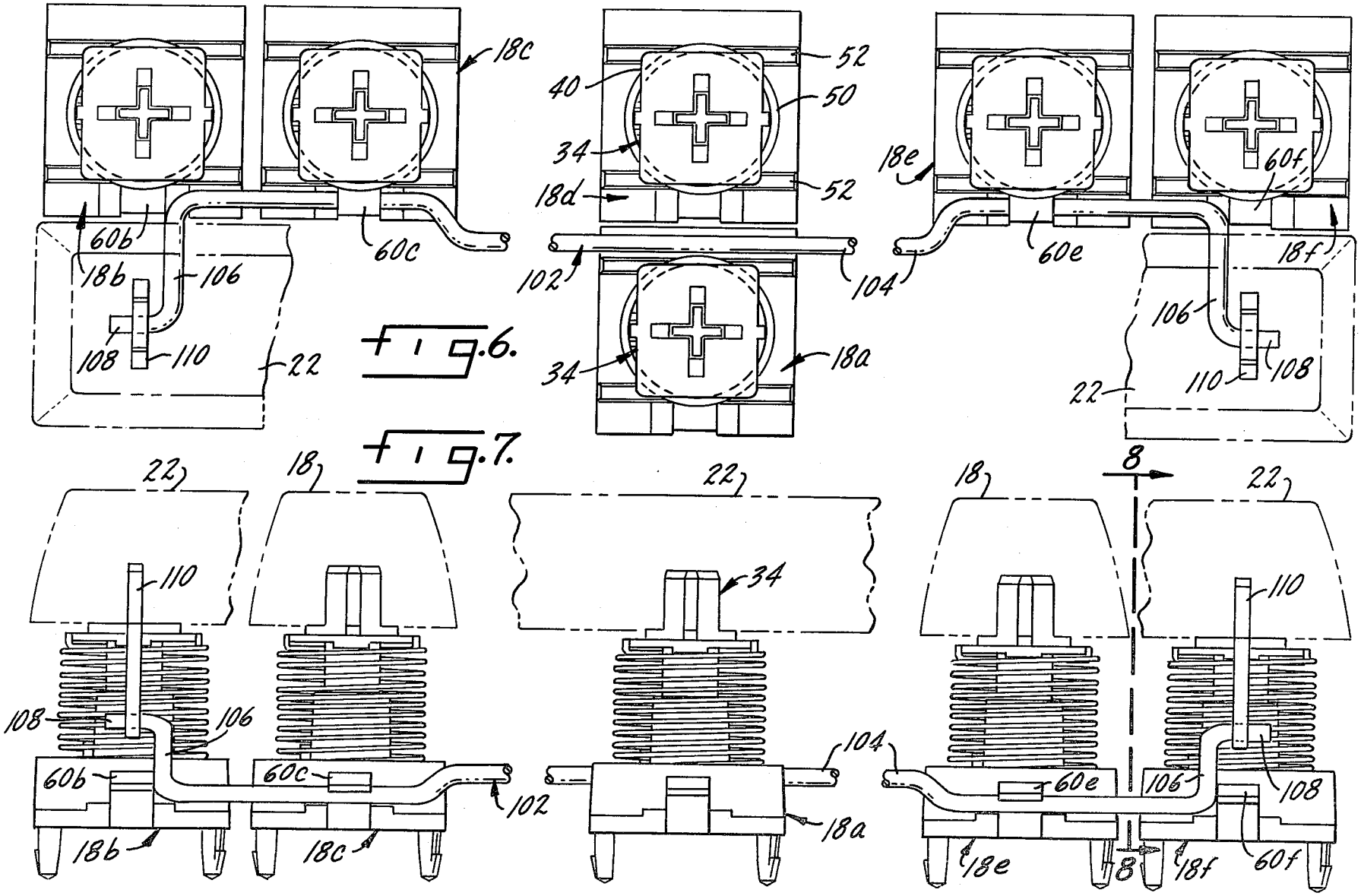
FIG. 6 is a plan view with portions removed of two adjacent rows of a keyboard assembly, showing several keys, one of which carries an elongated keytop.
FIG. 7 is a front elevation view of the array of keys shown in FIG. 6.

A first spring 50 biases the plunger upwardly. The spring bottoms on a pair of walls 52 which are part of the housing 26. The top of the spring 50 engages the corners of the shoulder 40 as best seen in FIG. 6. The extensions 42 and projections 44 assist in holding the spring in place against the shoulder 40.

The plunger 34 has a rod-like member 54 extending downwardly in the open area between the hooks 46. The member 54 supports and positions a coaxially-arranged second spring 56. The second spring 56 bottoms directly upon the membrane switch 14 and is the medium through which operating pressure is applied to the membrane switch. A slight recess 58 is provided at the bottom of the housing 26 to assure that no part of the housing inadvertently exerts pressure on the membrane.

A hook 60 is formed on each of the housings. Preferably the hook extends from one of the walls 52. The hook includes a hollowed out portion 62 for receiving a torsion rod 102. (see FIGS. 6–8). The purpose of the hook 60 will be explained below.

The switch modules may be arranged for either momentary or alternate action operation. The plunger includes a cam surface and, when arranged for alternate action operation, the housing will include a cam follower. The cam follower is indicated at 64 in FIGS. 2 and 3. It includes a generally upright elongated portion 66 and an upper projection 68 which is in engagement with the cam surface on the plunger. At the lower end there is a projection 70 extending in the direction opposite that of projection 68. A circular knob 72 is formed on the end of the projection 70.

The switch module includes means for receiving and retaining a cam follower which is added to a key after the key has been mounted on the base plate. It is important that each switch module have this capability of accepting a cam follower so that any switch in an array can be made an alternate action type switch. Thus, no special switch modules are required nor is it necessary to be sure that a special switch module is mounted in a particular location on a keyboard. Standard switch modules are used throughout the keyboard array but it is possible to adapt any of them for alternate action.

The cam follower retainer means incluces a catch 74 attached to the base of the housing. A pair of side posts 76 and back walls 78 cooperate with the catch 74 to define an enclosure which holds the cam follower. The catch 74 is separate from the side posts and back walls.

As best seen in FIG. 2, the cam follower 66 can be inserted into the enclosure by lifting the bottom of the first spring 50 and pushing the knob 72 down into the top of the enclosure. The catch 74 flexes outwardly to permit passage of the knob 72. Once the knob clears the projection on catch 74, the catch snaps back to engage the cam follower to retain it in position. The elongated portion 66 and the projection 70 of the follower lie in an opening between the two back walls 78. Also it will be noted that if the need arises the cam follower can be removed from the retainer means to convert an alternate action switch to momentary operation.

Looking at FIG. 3, the cam follower projection 68 is shown located at the lower end of a multiarea cam surface formed within a recess 80. The cam surface includes a lower flat surface 82 which is directly adjacent an up-ramp 84. At the end of up-ram 84 there is a small flat surface 86 which joins a larger flat surface 88, there being a small down step at the junction between surfaces 86 and 88. Adjacent surface 88 is a further flat surface 90, there being a step down at the junction between surfaces 88 and 90. The cam follower projection 68 would be positioned against surface 90 when the plunger is held in a depressed position. There is a raised area 92 directly beneath surface 90 which effectively holds cam follower projection 68 when the plunger is depressed for initial or operating action of the switch. When the switch is to be released, initial downward movement of the plunger will permit cam follower projection 68 to pass over a small step 94 which is formed at the junction between surface 90 and a larger flat surface 96. Adjoining surface 96 is a ramp 98 which is followed by an additional flat surface 100 and a small down step formed at the junction between surface 100 and lower surface 82. The type of cam and its association with the cam follower are generally in the switch art.

Figure 8:
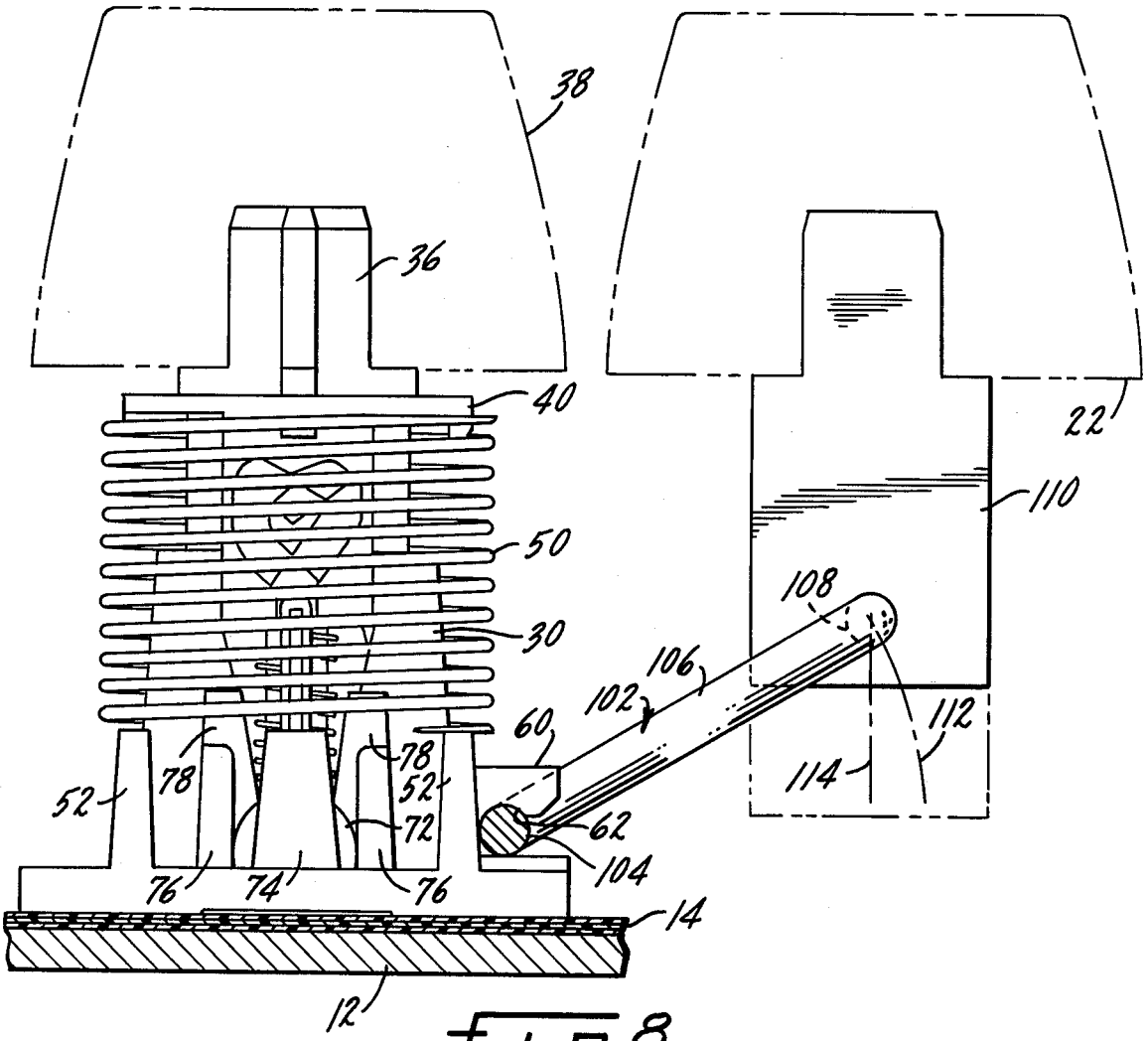
FIG. 8 is a side elevation view of the adjacent rows of keys as viewed along line 8—8 of FIG. 7.

A further aspect of the present invention is illustrated in FIGS. 6, 7 and 8. As stated above, certain keyboard arrays will include keys having elongated keytops. A common example is the spacer bar 22 of a standard typewriter keyboard. It is desirable from an inventory and assembly standpoint to use the same, standard switch module regardless of the width of a keytop. The difficulty presented by wide keytops is the user will apply pressure to the elongated keytop at a point remote from the plunger. The resulting moment about the plunger will tend to skew the plunger in the channel. The plunger will bind rather than move up and down freely.

The present invention avoids the binding problem by providing means for preventing creation of a moment about the plunger. This includes a torsion rod 102 which is connected to the elongated keytop or spacer bar 22. The torsion rod 102 has a shank 104 and two arms 106 formed at the end of the shank. The arms 106 extend substantially at right angles to the shank. At the end of the arms there are projections 108 which extend through guide members 110. The guide members 110 are attached to the elongated keytop such as spacer bar 22.

The shank 104 of the torsion rod is held by two of the hooks 60. The hooks are attached to switch modules in a row adjacent to the row containing the elongated keytop. This is best seen in FIG. 6. Key **18*a* carries an elongated keytop such as the spacer bar 22. The adjacent row has keys 18*b*, 18*c*, 18*d*, 18*e* and 18*f*. The torsion rod 102 is held by the hooks 60*c* and 60*e*. The torsion rod 102 and keys 18*b*–18*f* are configured such that the hooks 60*b* and 60*f* serve as abutment hooks to prevent longitudinal movement of the torsion rod. Thus the rod is free to rotate in the hooks 60*c* and 60*e* but is constrained from sliding longitudinally in the hooks by the abutment hooks 60*b* and 60*f*. When the elongated keytop is depressed, the torsion rod distributes the downward pressure to both guide members 110**. Any moment created about the plunger is balanced by an equal moment in the opposite direction. Thus, binding of the plunger is prevented.

FIG. 8 illustrates how the torsion rod assists in supporting the elongated keytop. It can be seen that when the shank 104 of the torsion rod rotates, the natural, uncontrained motion of the arm 106 would be in an arc such as that described by the line 112. However, since the elongated keytop or spacer bar 22 is constrained to vertical movement by the plunger of key 18*a* and since the keytop 22 is itself substantially rigid, the guide member 110 will also move vertically. So the end of the arm 106 must move straight up and down as described by the line 114. Thus the torsion rod is flexed during the downward motion of the elongated keytop. This loading of the torsion rod tends to urge the keytop back to the upraised position.

It can be seen that the switch module of the present invention forms a standard component with which any keyboard configuration can be formed. Every module is adapted for alternate action and every module is capable of supporting an adjacent elongated keytop. Special modules for these functions are eliminated. Proper placement of the standard modules on the baseplate, together with selective placement of cam followers, elongated keytops and torsion rods allows formation of any keyboard.

Whereas a preferred form of the invention has been shown and described, it should be realized that there may be many modifications, substitutions and alteration thereto. For example, those skilled in the art will realize that the cam follower retainer means and the means for preventing binding could be incorporated in a block-type keyboard wherein all the key housings are molded in a single block rather than the individual modules shown herein.

We claim:

1. In a keyboard assembly, a baseplate, a plurality of keys each have a housing attached to the baseplate, and an associated set of electrical contacts, a plunger movable within the housing to actuate said contacts when depressed, a keytop fixedly attached to the plunger, a cam surface formed on the plunger and a cam follower adapted to engage the cam surface to provide alternate action, the improvement comprising means formed on the housing for receiving and retaining a cam follower, said means being accessible from above the baseplate such that a cam follower can be inserted into said means after a fully-assembled key has been mounted on the baseplate.

2. The structure of claim 1 further characterized in that the cam follower retainer means includes a catch engageable with the cam follower to retain it in position, the catch being flexible to allow receipt of the cam follower.

3. The structure of claim 2 further characterized in that the catch can be flexed to permit removal of a cam follower.

4. The structure of claim 1 further characterized in that the cam follower retainer means defines an enclosure formed by a pair of side posts, a back wall and a catch, the catch being flexible to allow a receipt of a cam follower into the enclosure, after which the catch is engageable with the cam follower to retain it in the enclosure.

5. The structure of claim 4 wherein the catch is a generally elongated member attached at one end to the housing and separated from the side posts.

6. In a keyboard assembly, a baseplate, a plurality of individual keys each having a separate housing attached to the baseplate, a set of electrical contacts associated with each key, a plunger movable within the housing to actuate said contacts when depressed, a keytop fixedly attached to the plunger, a cam surface formed on the plunger and a cam follower adapted to engage the cam surface to provide alternate action, the improvement comprising a housing having means formed thereon for receiving and retaining a cam follower, said means being accessible from above the baseplate such that a cam follower can be inserted into said means after a fully-assembled key has been mounted on the baseplate.

7. The structure of claim 6 further characterized in that the cam follower retainer means include a catch engageable with the cam follower to retain it in position, the catch being flexible to allow receipt of the cam follower.

8. The structure of claim 6 further characterized in that the catch can be flexed to permit removal of a cam follower.

9. The structure of claim 6 further characterized in that the cam follower retainer means defines an enclosure formed by a pair of side posts, a back wall and a catch, the catch being flexible to allow receipt of a cam follower into the enclosure, after which the catch is engageable with the cam follower to retain it in the enclosure.

10. The structure of claim 9 wherein the catch is a generally elongated member attached at one end of the housing and separated from the side posts.

11. In a keyboard assembly of the type having a baseplate and at least two rows of keys attached to the baseplate, each key having an associated set of electrical contacts, a movable plunger adapted to actuate said contacts when depressed, a keytop affixed to the plunger and a housing for supporting the plunger, the improvement comprising means for preventing binding of a plunger having an elongated keytop, said means including a torsion rod connected to the elongated keytop and at least one hook attached to a housing of a key in a row adjacent to the row containing the elongated keytop, the torsion rod being held by said hook.

12. The structure of claim 11 further comprising a pair of abutment hooks attached to housings at a point where said abutment hooks serve to prevent longitudinal movement of the torsion rod.

13. The structure of claim 11 wherein the elongated keytop is affixed to its plunger at the middle of the keytop.

14. In a keyboard assembly of the type having a baseplate and at least two rows of individual keys attached to the baseplate, each key having an associated set of electrical contacts, a movable plunger adapted to actuate said contacts when depressed, a keytop affixed to the plunger and a housing for supporting the plunger, the housing having hook means attached thereto, the hook adapted to receive and retain means for preventing binding of a plunger in an adjacent row and having an elongated keytop.

15. The structure of claim 14 wherein said means for preventing binding includes a torsion rod connected to the elongated keytop.

16. The structure of claim 15 wherein the hook means are located such that a pair of hooks at either end of the torsion rod serve as abutments to prevent longitudinal movement of the torsion rod.

17. The structure of claim 14 wherein the housing further includes at least two legs extending downwardly from the base of the housing into openings in the baseplate, the legs snapping into the openings to provide an interim retention means for holding the housing on the baseplate.

18. The structure of claim 14 wherein the housing further includes at least two projections formed on opposite corners of the underside of the housing, the projections compensating for any lack of flatness in the housing.

19. In a keyboard assembly, a baseplate, at least two rows of individual keys attached to the baseplate, each key having an associated set of electrical contacts, a movable plunger adapted to actuate said contacts when depressed, a keytop affixed to the plunger, a spring biasing the plunger upwardly, and a housing for supporting the plunger, the housing constraining the plunger to vertical movement, the improvement comprising means for assisting said spring in supporting an elongated keytop, said means including at least one hook means attached to a housing of a key in a row adjacent to the row containing the elongated keytop, and a torsion rod having a shank held by said hook means and at least one arm connected to the elongated keytop, the vertical downward movement of the plunger and elongated keytop altering the natural arcuate movement of the arm thereby causing the torsion rod to flex, which assists the spring in returning the plunger to a raised position.

* * * * *